US006772668B2

(12) United States Patent
Shields

(10) Patent No.: US 6,772,668 B2
(45) Date of Patent: Aug. 10, 2004

(54) AMMUNITION RELOADING APPARATUS WITH FEED MECHANISM

(75) Inventor: Steven Robert Shields, Oroville, CA (US)

(73) Assignee: Alliant Techsystems, Inc., Edina, MN (US)

( * ) Notice: Subject to any disclaimer, the term of this patent is extended or adjusted under 35 U.S.C. 154(b) by 0 days.

(21) Appl. No.: 10/214,977

(22) Filed: Aug. 7, 2002

(65) Prior Publication Data

US 2004/0025678 A1 Feb. 12, 2004

(51) Int. Cl.[7] ..... F42B 33/02

(52) U.S. Cl. ..... 86/31; 86/27; 86/29; 86/36; 86/44

(58) Field of Search ..... 86/27, 29, 31, 86/36, 44

(56) References Cited

U.S. PATENT DOCUMENTS

| | | | | | |
|---|---|---|---|---|---|
| 284,874 | A | * | 9/1883 | Marsters | 86/31 |
| 1,604,145 | A | * | 10/1926 | Candee | 86/31 |
| 3,036,489 | A | | 5/1962 | Puth | |
| 3,053,132 | A | | 9/1962 | Lee et al. | |
| 3,057,247 | A | | 10/1962 | Behrens | |
| 3,157,086 | A | * | 11/1964 | Bachhuber | 86/27 |
| 3,450,000 | A | * | 6/1969 | Ponsness | 86/25 |
| 3,771,411 | A | * | 11/1973 | Hazel | 86/27 |
| 3,796,127 | A | | 3/1974 | Deitemeyer | |
| 3,857,319 | A | * | 12/1974 | Welch | 86/23 |
| 4,031,804 | A | * | 6/1977 | Boschi | 86/23 |
| 4,065,997 | A | | 1/1978 | Allen | |
| 4,163,410 | A | | 8/1979 | Dillon | |
| 4,186,646 | A | | 2/1980 | Martin | |
| 4,292,877 | A | | 10/1981 | Lee | |
| 4,418,606 | A | | 12/1983 | Lee | |
| 4,522,102 | A | | 6/1985 | Pickens | |
| 4,526,084 | A | | 7/1985 | David et al. | |
| 4,637,291 | A | | 1/1987 | Alexander | |
| 4,869,148 | A | | 9/1989 | Tucker | |
| 4,887,509 | A | | 12/1989 | Hodulik | |
| 5,024,135 | A | | 6/1991 | Bender | |
| 5,040,449 | A | * | 8/1991 | Lee | 86/27 |
| 5,202,529 | A | | 4/1993 | Shields | |
| RE34,612 | E | | 5/1994 | Bender et al. | |
| 5,649,465 | A | | 7/1997 | Beebe | |

OTHER PUBLICATIONS

RCBS, Reloading Presses, Scales, Dies and Supplies, Dec. 02, 2001, taken from http://web.archive.org/web/2001120209474/www.rcbs.com/np2001/np01con.html, pp. 1 and 2.*

* cited by examiner

*Primary Examiner*—Charles T. Jordan
*Assistant Examiner*—Bret Hayes
(74) *Attorney, Agent, or Firm*—Klarquist Sparkman LLP

(57) ABSTRACT

Ammunition reloading apparatus includes a shell case support for holding a shell case, a container spaced above the support for holding shell loading material to be placed in a shell case during reloading, and an elongate charge bar underlying the container having a charge opening therein. The bar is mounted for movement between a first position in which the opening underlies the container to receive a charge of material and a second position where the material may be released to an underlying shell case. Control mechanism is operable to sense the presence or absence of the shell case on the support when the charge bar is in its second position. The control mechanism prohibits release of material from the charge opening when a shell case is absent and permits release of material to be dispensed to the shell case when a shell case is present.

38 Claims, 5 Drawing Sheets

5A
5B
60
64
96
104
80
92
100
98
82
90
86c
86c
108
128
124
122
86a
94
114
110
113
112
126
120
70a
108
156
158
150b
70
156c
150b
150
118
72
150
16
72a
72c
74c
74
130
150a
74a
72b
74b
144
146
142
146
50
130a
34C
148
34E
134
20
136
20a
148
20
132
5A
5B
140
20
140

AMMUNITION RELOADING APPARATUS WITH FEED MECHANISM

FIELD OF THE INVENTION

This invention relates to apparatus for reloading ammunition, and more particularly to such apparatus which includes feed mechanism for dispensing shell loading material to a shell case.

BACKGROUND

It is very common for active shooters to load or reload ammunition. The savings to the shooter can be substantial. Just as important to many is that ammunition can be custom tailored to fit the shooter's concept of ideal ammunition for the shooter's particular needs.

Where previously fired ammunition is to be reloaded, several steps are involved. For reloading hard case rifle or pistol ammunition, the spent primer is removed, the case is resized to correct expansion which occurs during prior firing, a new primer and powder are inserted, a bullet is seated in the mouth of the shell case, and the case mouth may be crimped to hold the bullet therein.

In the reloading of shot shell cases, the spent primer is removed and the case is resized to bring it into conforming shape from any expansion which may have occurred from previous firing. A new primer then is inserted and the shell case is loaded with powder, an over powder wad, and shot. Following these operations, the mouth of the shell case is crimped to close its forward end.

These operations may be accomplished in a single-stage reloading press, or more advantageously in a progressive loader in which several shell cases are held in a support for movement between a number of sequential stations for producing each of the operations set out above in its proper sequence. Where progressive loading apparatus is used, mechanism often is provided for automatically dispensing flowable shell loading material, or components, such as powder (for both hard case rifle and pistol ammunition and shot shells) and shot (used in shot shells).

Generally, in loading and reloading apparatus a shell case is held at its base and various operational apparatus is mounted thereover, with mechanism for moving the shell case and operating mechanism vertically relative to each other to bring them into proximity. As this occurs, a metered amount of flowable component, be it powder or shot, may be dispensed into the case at the appropriate time in the reloading sequence.

It is desirable to have some means for detecting the presence or absence of a shell case to receive shell loading material during an operational sequence so that the material is not dispensed if a shell case is not available to receive it.

In the past, various apparatus has been devised in an attempt to detect the presence or absence of a shell case. However, such have not been as convenient to manufacture or use as may be desired or may not provide as positive an action as desired.

BRIEF SUMMARY

The present invention includes novel reloading apparatus for dispensing flowable component, or shell loading, material having mechanism for detecting the presence or absence of a shell case to receive such material and permitting dispensing only upon sensing the presence of a shell case in a proper location.

Further, the invention includes novel dispensing mechanism having a dispensing tube which will be vertically shifted only on the relative movement of a shell case to receive shell loading material, and such vertical movement of the dispensing tube produces opening of a dispensing channel.

An object of the invention is to provide reloading apparatus having novel mechanism for dispensing flowable material into shell cases, such that material is dispensed only when a shell case is properly positioned for receiving such.

DESCRIPTION OF PREFERRED EMBODIMENT

Figure 1:
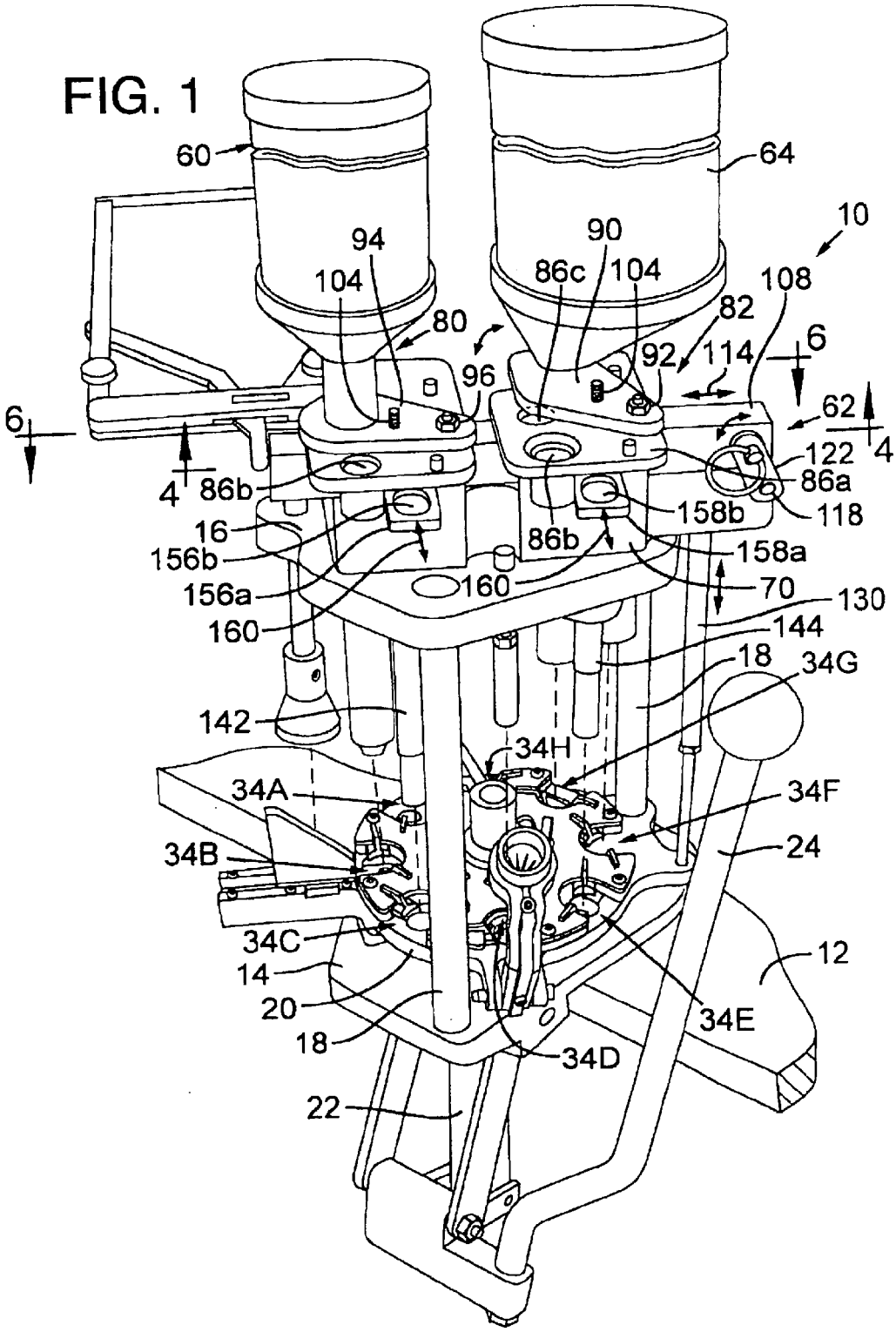
FIG. 1 is a perspective view of ammunition reloading apparatus according to an embodiment of the invention.

In FIG. 1, a perspective view of a shot shell reloader 10 is shown. While the reloader will be described herein for reloading shot shells, it should be understood the invention can be used in other types of reloading, such as for rifle and pistol shell reloading.

The reloading apparatus illustrated is a progressive reloading press in which multiple ammunition shell cases are held in the press and upon each actuation of the press the cases are moved into engagement with successive tools and workstations with a series of operating elements to reload the cases. The successive positions, or stations, include a station in which a spent primer is removed from the base of a previously fired shell case and where the outer diameter of the case is sized, another where a primer is inserted and another where a selected measure of powder is placed in the case. Where shot shell ammunition is reloaded, a station is provided where a wad is placed over the powder, another where a measure of shot is placed over the wad, and successive stations where appropriate crimping of the mouth of the shell occurs. Where rifle or pistol ammunition is to be loaded following placement of powder in the shell case, a bullet is inserted.

The progressive reloading press is mounted on a workbench 12. The press includes a base 14 secured to the bench and a die holding shelf 16 supported a distance above base 14 by a plurality of pillars 18. A plurality of dies and other operating mechanism for performing selected reloading operations are mounted on shelf 16.

A shell case support including a shell plate holder 20 is mounted atop an upright ram, or rod, 22. The ram is shiftable vertically from a lowered position, as illustrated in FIG. 1, with shell plate holder 20 adjacent base 14, to a position raised therefrom toward shelf 16. A user may forcefully swing handle 24 to the left from the position shown in FIG. 1 which serves to raise ram 22 and shell plate holder 20.

Return of the handle to the position illustrated in FIG. 1 lowers plate holder 20 to the position shown. Appropriate operating linkage is provided between ram 22 and handle 24 to produce this raising and lowering of the shell plate holder. Shell plate holder 20 mounted atop ram 22 moves vertically with ram 22 but does not rotate about an upright axis.

Figure 2:
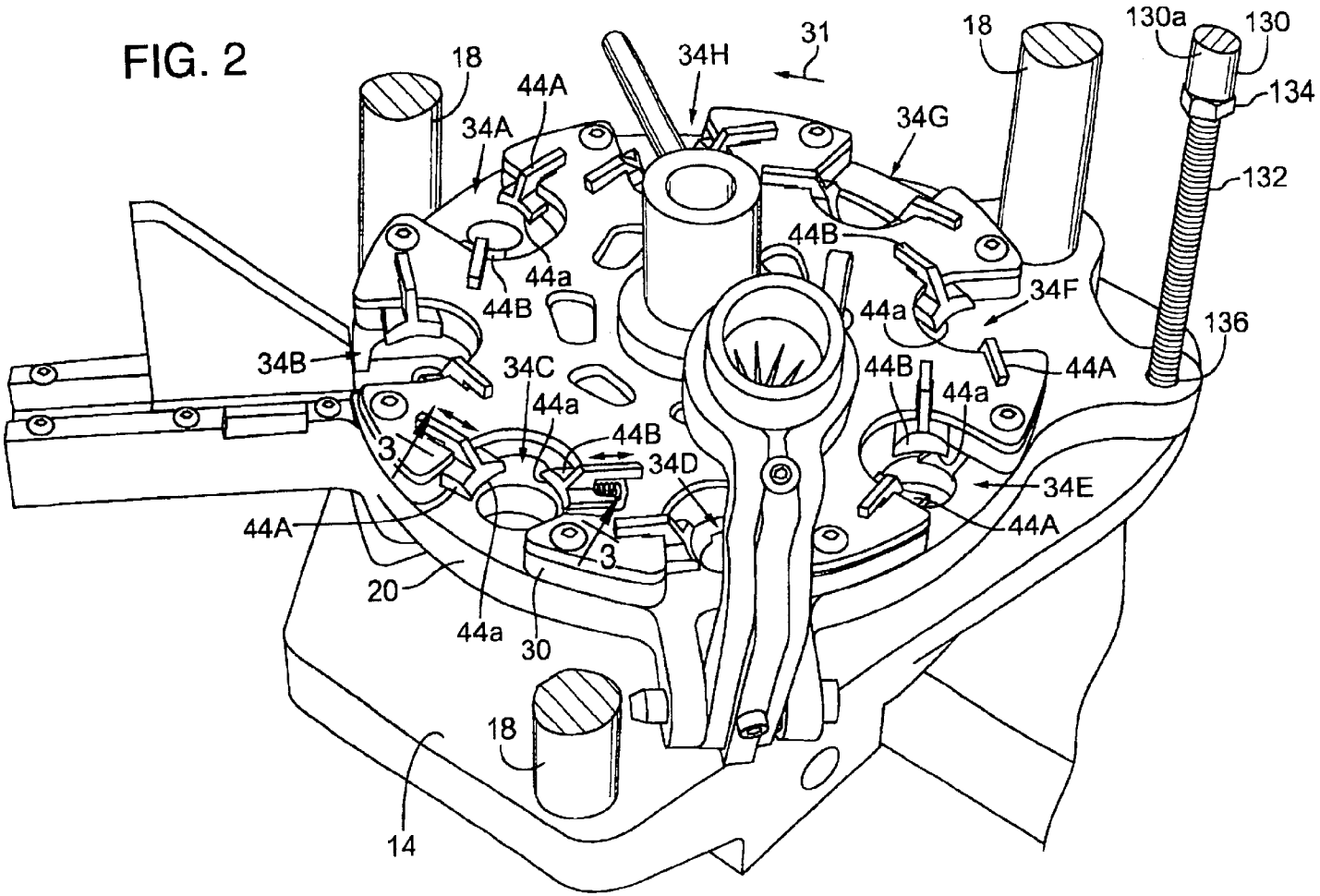
FIG. 2 is an enlarged perspective view of shell case holding mechanism in the apparatus of FIG. 1.

Mounted atop shell plate holder 20 is a shell plate 30 which is mounted on shell plate holder 20 for rotation in a counterclockwise direction as indicated by arrow 31 (see FIG. 2). The shell plate 30 has a plurality of spaced-apart cavities 34A–34H formed in a circumferential outer edge adapted to receive the bases of ammunition shell cases to be reloaded. Each of the cavities 34A–34H has a pair of spring-biased shell holding, or gripping, fingers, or members, 44A, 44B which project yieldably into each of the cavities.

Figure 3:
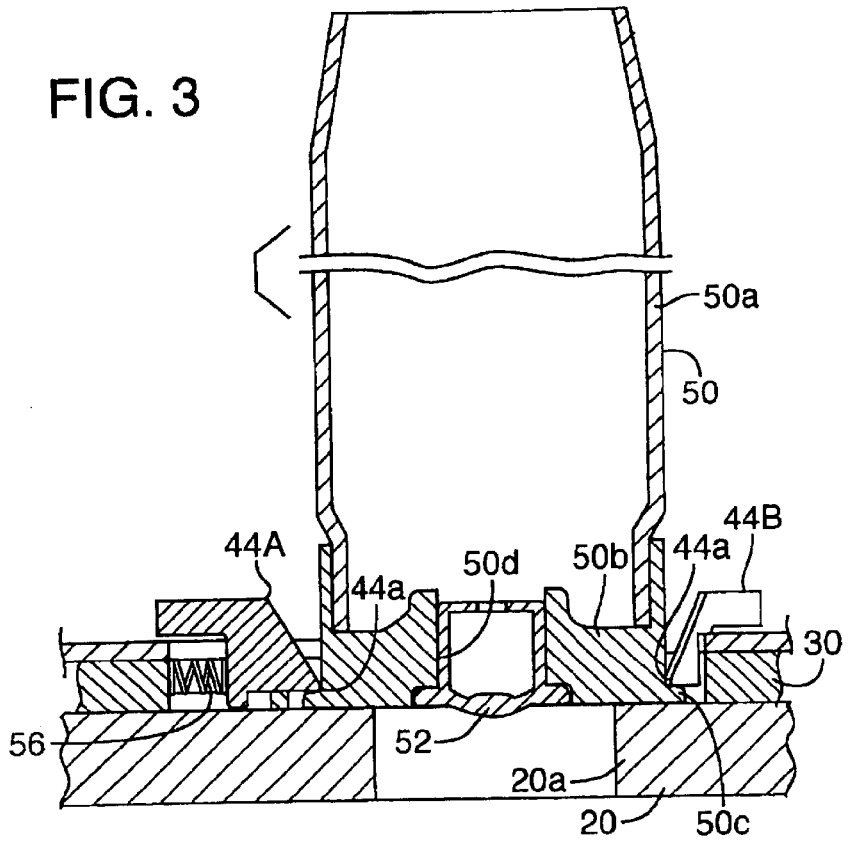
FIG. 3 is an enlarged cross-sectional view taken generally along the line 3—3 in FIG. 2 illustrating a shell case held in the mechanism for progression through the loading process.

The operation of fingers 44A, 44B is best illustrated in FIG. 3. Here a shotgun shell case 50 is shown held in one of the cavities in the shell holding support by a pair of fingers 44A, 44B. The shell case has a substantially cylindrical main body portion 50*a* and a base 50*b* with a radially outwardly projecting rim 50*c* at its lower end. A primer, or primer cap, 52 is held in a primer receiving pocket 50*d* in the shell case. The base of the shot shell case 50*b* rests on shell plate holder 20 and overlies a bore, or hole 20*a* extending vertically through the shell plate holder. Such bore 20*a* underlies each of cavities 34A–34H which may receive and hold a shell case for operation.

The gripping fingers, or members, 44A, 44B each have an arcuate inwardly facing gripping rim 44*a* which is spaced a distance above the top of shell plate holder 20 and positioned to engage and grip rim 50*c* of the shell case as illustrated in FIG. 3. Springs, such as that illustrated at 56, urge the fingers inwardly toward the center of the associated cavity to yieldably hold the shell case in place.

As best seen in FIGS. 1 and 2, the shell holding cavities, or stations, on the shell plate holder are arranged in a circular pattern, such that as shell plate 30 rotates in the direction of arrow 31 it will stop upon each actuation of handle 24 with a cavity 34A–34H under one of the operating stations of mechanism mounted on shelf 16. Explaining further, cavity 34A is in an initial station in the progressive reloader where a shell case would be inserted laterally to rest on shell plate holder 20 and be held therein by a pair of fingers 44A, 44B. Each time handle 24 is swung to the left, the shell plate holder and its associated apparatus are raised toward shelf 16 and a shell case held thereon is moved toward operating tools and equipment mounted on shelf 16 to perform an operation on a shell case. As handle 24 is swung again to the right, the shell plate holder 20 is lowered and actuating mechanism which is known in the art causes shell plate 30 to rotate one station in a counterclockwise direction so that shell cases held thereon move progressively and sequentially into position relative to successive reloading stations.

Describing the operations at each of the stations illustrated, a shell case held in cavity 34A would be resized and have its primer cap removed upon actuation of lever 24. In the position, or station, of cavity 34B, a shell case would have a primer inserted in its base end. At position, or station, 34C, a selected quantity of powder from a hopper 60 would be dispensed via a slide bar measuring or metering mechanism 62 into the waiting shell case. At station 34D, an appropriate wad would be placed over the powder and tamped therein. At station 34E, a measured quantity of shot from a hopper 64 would be dispensed by slide bar mechanism 62 into the shell case over the inserted wad. At successive stations 34F, 34G, the mouth end of the shell case would be crimped over to close the mouth of the shot shell. At station 34H, appropriate mechanism would roll crimp and operate to force a reloaded shell from the apparatus.

Referring to FIGS. 1, 4, 5A and 5B, a slide bar support indicated generally at 70 is formed as a part of a casting with shelf 16 and projects upwardly from the substantially horizontally disposed planer portion of shelf 16. Support 70 and shelf 16 have a pair of vertically disposed laterally spaced bores 72, 74 extending therethrough. Each bore has an upper bore portion 72*a*, 74*a*, respectively, of a selected first diameter, and a lower bore section 72*b*, 74*b*, of a smaller diameter which produces a shelf 72*c*, 74*c* at the juncture between the two bore sections.

A pair of hopper mounting assemblies 80, 82 are secured atop slide support 70 in laterally spaced relationship and support hoppers 60, 64, respectively. Assemblies 80, 82 are substantially similar, and thus only one will be described in detail.

Figure 6:
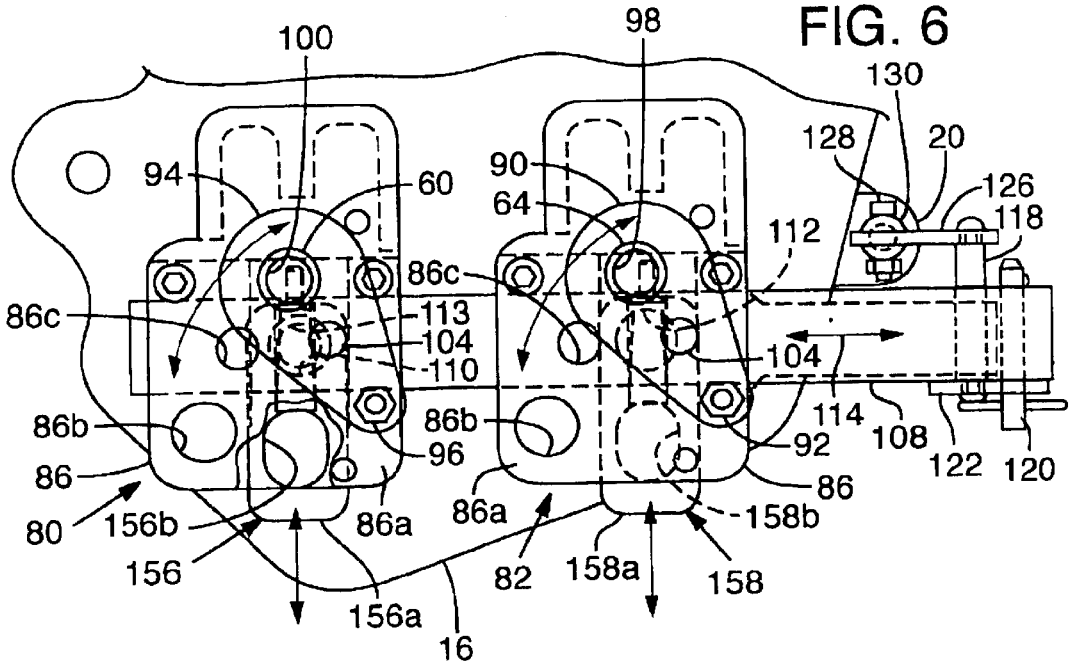
FIG. 6 is an enlarged view taken generally along the line 6—6 in FIG. 1.
Figure 4:
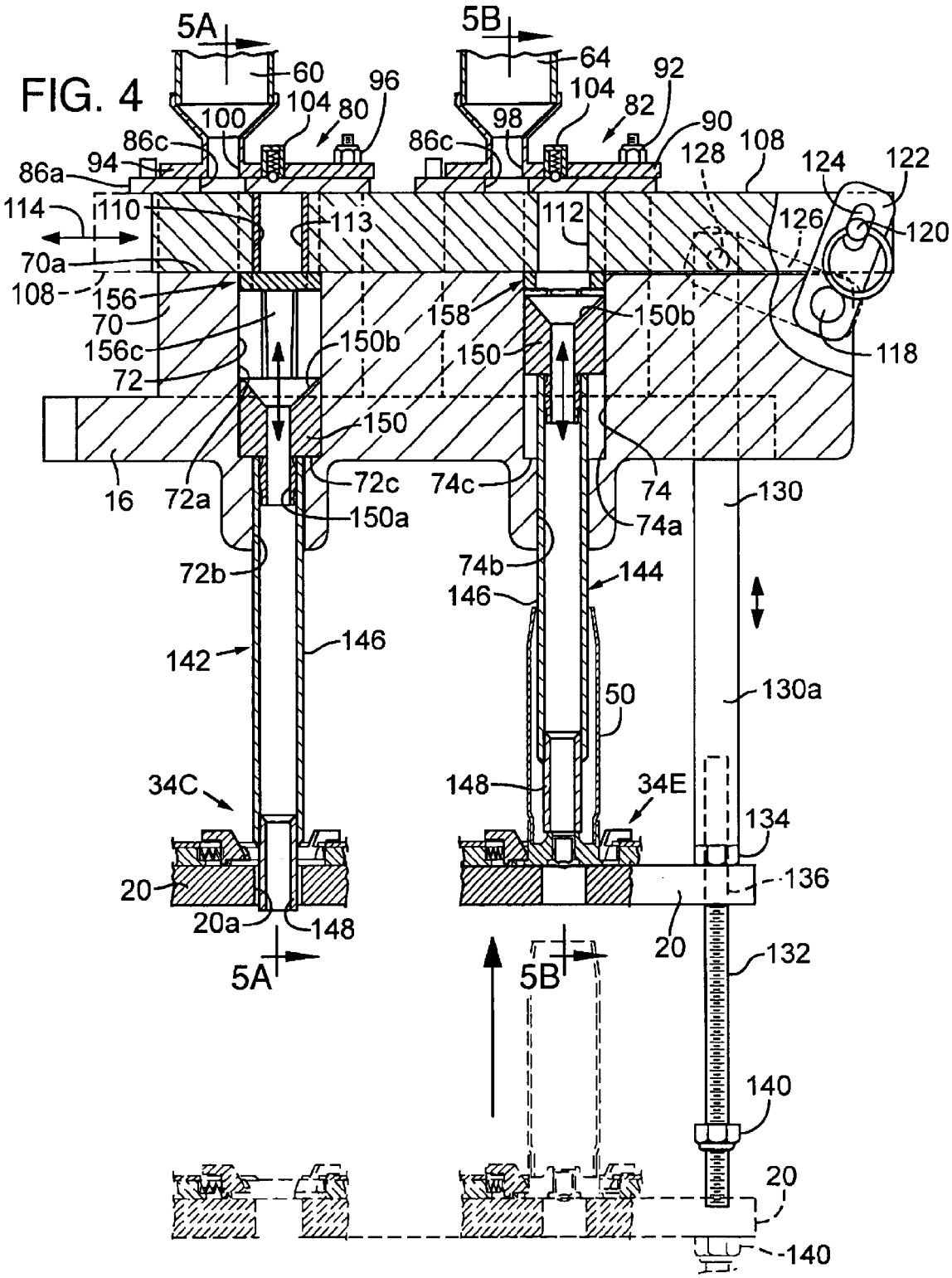
FIG. 4 is an enlarged cross-sectional view taken generally along the line 4—4 in FIG. 1.
Figure 5B:
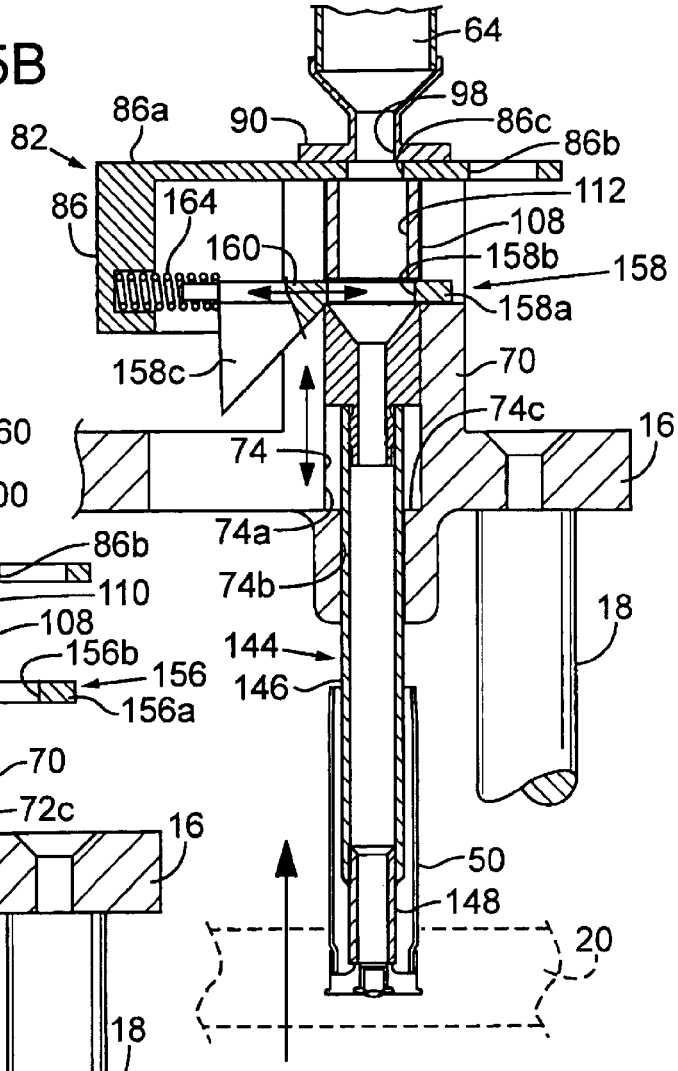
FIG. 5B is a view taken generally along the line 5B—5B in FIG. 4.

Referring to assembly 82, and more particularly FIGS. 4, 5B, and 6 the assembly includes a formed mounting block 86 secured atop slide support 70 and extending rearwardly therefrom. The mounting block has a top plate portion 86*a* which has two bores 86*b*, 86*c* extending therethrough.

A hopper mounting plate 90 lies substantially flat against the top of top plate 86*a* and is pivotally connected through a pivot bolt connection 92 adjacent one of its ends to permit swinging of plate 90 in a horizontal plane over top plate 86*a*. A similar hopper mounting plate 94 with a pivot mounting bolt 96 adjacent one of its ends is mounted for pivotal movement over the top plate portion of the mounting block assembly in the hopper mounting assembly. Hopper 64 is mounted on hopper mounting plate 90 with a bore 98 extending therethrough through which flowable shell loading material, or component, such as shot, may flow to be dispensed to an underlying case as will be explained in greater detail below. Hopper 60 is mounted atop mounting plate 94 and has a bore 100 extending through mounting plate 94 for the dispensing of flow material, such as powder, to be dispensed to a case as will be explained below.

The hopper mounting plates 90, 94 are swingable about their respective pivot mounting bolts between a first position as illustrated for hopper 64, in which its underlying bore 98 rests against a solid portion of top plate 86*a*, such that material in the hopper has no escape. The hoppers also may be swung to a second position such as illustrated for hopper 60 in FIG. 1 wherein its bore 100 is aligned with associated bore 86*c* in top plate portion 94. Each of the hoppers also is swingable to a third position with its outlet bore aligned with bore 86*b* in its associated mounting plate, permitting material in the container to be dumped as desired. In such situation, an outfeed tube would be attached to the underside of bore 86*b* to direct material from the respective hopper to a container. A spring-biased ball and detent assembly indicated generally at 104 for each of the hopper mounting assemblies serves to releasably hold the hopper mounting plate of each of the hoppers in a selected one of the positions described.

An elongate horizontally disposed slide bar, or charge bar, also referred to as a transport member, 108 is mounted for longitudinal sliding movement over slide bar support 70 and within the confines of a portion of hopper mounting assemblies 80, 82. The slide bar 108 has a pair of vertical bores 110, 112 extending fully therethrough. The slide bar 108 is reciprocably shiftable longitudinally in the direction of arrow 114 between a first, or receiving, position, shown generally in dashed outline in FIG. 4, in which bores 110, 112 are disposed directly below bores 100, 98 of hoppers 60, 64, respectively. In this position, flowable component material, such as powder from hopper 60 and shot from hopper 64, may flow into and be held in bores 110, 112, respectively. The slide bar 108 may be shifted longitudinally to a second, or dispensing, position as illustrated in solid outline in FIG. 4, wherein bores 110, 112 overlie bores 72, 74 for dispensing flowable component material held therein.

The top surface 70*a* of slide bar support 70 and the bottom surface of slide bar 108 have complementary configurations such that material in bores 110, 112 are held thereon as bar 108 moves between its first and second positions. In the illustrated embodiment, these surfaces are substantially planar.

Bushings, or sleeves, of selected size as indicated generally at 113 in bore 110, may be inserted in the bores to revise the usable size of bores 110, 112 and thus determine the quantity of material which may be received in and dispensed from each bore.

Shifting of slide bar 108 between its first and second positions is controlled by linkage mechanism operatively interconnecting shell plate holder 20 and the slide bar. Explaining further, a pin 118 extends rotatably through slide support 70 adjacent one end of the support. A connecting pin 120 extending through slide bar 108 projects from one side of the slide bar. A link bar 122 is secured adjacent one of its ends to pin 118 for rotation therewith and has an elongate slot 124 receiving pin 120.

Another link bar 126 is rigidly secured adjacent one of its ends to the end of pin 118 opposite that to which bar 122 is secured. The opposite end of link bar 126 is connected by a pin 128 to the upper end of an operating rod 130 which includes an upper portion 130*a*. The lower end of portion 130*a* has an elongate threaded rod 132 screwed into a threaded bore therein, with a lock nut 134 serving to lock threaded rod 132 in a selected position relative to portion 130*a* permitting variation in the overall length of rod 130.

Referring to FIGS. 2 and 4, rod 132 extends through a bore 136 in shell plate holder 20 and a nut 140 screwed on rod 132 underlies shell plate holder 20.

Explaining briefly the operation of the linkage mechanism, when the shell plate holder is in its lowered position, as illustrated in FIGS. 1, 2 and in dashed outline in FIG. 4, rod 130 is pulled downwardly, thus swinging link bars 126, 124 to the left which produces movement of slide bar 108 to its first position with bores 110, 112 underlying bores 100, 98 in hoppers 60, 62. Upon raising of the shell plate holder 20 to the position illustrated in FIG. 4, the shell plate holder engages lock nut 134 raising rod 130 and swinging link bars 122, 126 in a clockwise direction to the position illustrated in FIG. 4 with bores 110, 112 moved from their positions underlying the hoppers to their second positions overlying bores 72, 74. Lowering shell plate holder 20 causes the bottom of the shell plate holder to engage nut 140 again to swing the link bars counterclockwise and move slide bar 108 back to its first position ready to receive materials from hoppers 60, 64.

The distance between nuts 134, 140 produces lost motion linkage between support 20 and slide bar 108. Explaining further, when support 20 is raised from its fully lowered position, it will not engage nut 134 to shift slide plate from its first position toward its second position until the support has been raised a selected distance. Similarly, lowering of support 20 from its fully raised position will not initiate movement of slide bar 108 from its second toward its first position until the support has lowered a selected distance.

Figure 5A:
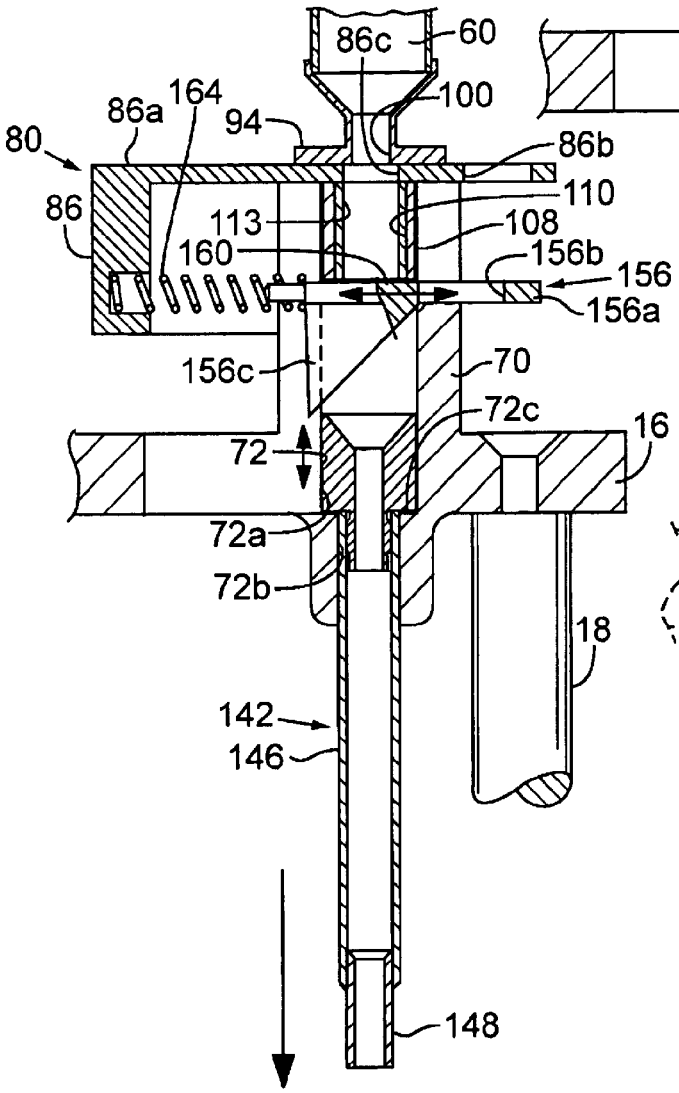
FIG. 5A is a view taken generally along the line 5A—5A in FIG. 4.

Referring to FIGS. 4, 5A, 5B, a first sensing and dispensing tube assembly 142 is shown mounted slidably in bore 72 and another sensing and dispensing tube assembly 144 is shown slidably mounted in bore 74. These assemblies are substantially similar. Each tube assembly includes a rigid cylindrical main tube 146 and a rigid ancillary tube 148 which also may be referred to as a lower end tube portion, or tube section, secured to and depending longitudinally from the lower end of tube 146. Ancillary tube 148 has a smaller outer diameter than tube 146. Secured to the upper end of tube 146 is a funnel block 150. Block 150 has an internal bore 150*a*extending therethrough which has a diverging funnel-shaped upper end 150*b*. Block 150 is received in bore portions 72*a*, 74*a* of the respective bores for vertical sliding movement therein, with its downward sliding movement stopped by shoulders 72*c*, 74*c*, respectively. Tubes 146 extend slidably downwardly and coaxially through bore portions 72*b*, 74*b*, respectively. The tube assemblies 142, 144 are positioned to receive material from bores 110, 112 of slide bar 108 when the slide bar is in its dispensing position as illustrated in FIG. 4. The lower ends of tube assemblies 142, 144 are positioned in the apparatus to directly overlie the positions of shell plate holder cavities 34C, 34E as illustrated in FIGS. 1 and 2.

As previously described, bores 20*a* underlie each of the shell case holding cavities on the shell case support 20. The ancillary tube portion 148 of each of the tube assemblies has a diameter, or side-to-side cross-sectional configuration, smaller than the diameter, or side-to-side cross-sectional configuration, of bores 20*a*, such that the lower end portion 148 may extend freely through a bore 20*a*.

Material dispensing control assemblies 156, 158 are positioned below slide bar 108 and above each of tube assemblies 142, 144, respectively. The dispensing control assemblies include substantially horizontal disposed slide plates, or control members, 156*a*, 158*a* mounted for horizontal-sliding movement in directions indicated by arrows 160. Each of the plates is substantially solid throughout a major portion of its length, but also has a bore 156*b*, 158*b* adjacent one end thereof. The plates are mounted for sliding movement between a first, or stop, position, illustrated for plate 156*a* in FIG. 5A wherein it prevents material in a bore of the charge bar from being dispensed into an underlying dispensing tube. The plate also is shiftable to a second, or dispensing, position as illustrated for plate 158*a* in FIG. 5B slid rearwardly, or to the left, in FIG. 5B to a position in which its bore 158*b* aligns with its underlying dispensing tube permitting material from the slide bar to flow therethrough into the underlying dispensing tube. Compression springs indicated generally at 164 yieldably urge plates 156*a*, 158*a* toward their first, or closed, position, as illustrated for plate 156*a* in FIGS. 4 and 5A.

The plates each have a triangular shaped depending operator plate portion indicated at 156*c*, 158*c* thereon.

When a tube assembly, such as that indicated at 142 in FIGS. 4 and 5A, remains in its lowered position, no force acts on plate portion 158*c* and its associated dispensing control assembly remains in the closed position illustrated for assembly 156 in FIGS. 4 and 5A. However, when an associated tube assembly, such as that indicated at 144 in FIGS. 4 and 5B is raised as illustrated therein, the top of funnel block 150 engages plate member portion 158*c* and urges its associated plate 158*a* to move to the left against the urging force of spring 164 to the dispensing position illustrated in FIGS. 4 and 5B for control assembly 158.

Describing operation of the assembly as thus described, during the reloading operation each time lever, or handle 24, is swung to the left, shell plate holder 20 is raised to move shell cases held thereon axially upwardly toward the overlying shelf 16 and the operating equipment mounted thereon. In the case of the shell loading materials held in containers 60, 64, such will be dispensed into a station at the shell plate holder only if a shell case is present to receive such material.

Referring to FIGS. 4 and 5A, slide bar 108 initially is in a first, or receiving, position shown in dashed outline in FIG. 4. In this initial position, bores 110, 112 underlie bores 100, 98, respectively, to receive materials from hoppers, or containers, 60, 64. As the shell plate holder is raised to the position illustrated in solid outline in FIG. 4, slide bar 108 which has received a charge of material in each of bores 110, 112 from their respective overlying hoppers 60, 64, will be shifted to the right as illustrated in FIG. 4, such that bores 110, 112 overlie tube assemblies 142, 144, respectively. In FIGS. 4 and 5A, it will be seen that no shell case is held in station, or cavity, 34C on shell plate holder 20. Thus, as the shell plate holder is raised to the position illustrated in FIGS. 4 and 5A, ancillary tube section 148 of tube assembly 142 merely extends loosely through bore 20*a* and is not raised from the position illustrated with block 150 resting on shoulder 72C. Since tube assembly 142 is not forcefully raised, dispensing control assembly 156 remains in the blocking, or closed, position illustrated in FIGS. 4 and 5A, preventing shell loading material, such as powder, from being dispensed from bore 110 in the slide bar. The apparatus thus senses the absence of a shell case and prohibits dispensing to the station where no shell case is held.

Referring to FIGS. 4 and 5B, a shell case 50 is shown held in cavity, or station, 34E of the shell plate holder by fingers 44A, 44B. As the shell plate holder is raised to the solid outline position shown in FIGS. 4 and 5B, the lower end of tube section 148 engages the interior portion of the base 50*b* of the shell case and tube assembly 144 is shifted upwardly to the position illustrated in FIGS. 4 and 5B. During this raising process, the upper end of funnel block 150 engages portion 158*c* of the dispensing control assembly and slides its associated plate 158*a* rearwardly against the urging of spring 164, such that its opening 158*b* is aligned with bore 112 and the dispensing tube assembly. In this position, material, such as shot, may be dispensed from bore 112, assembly 144, and into case 50. Here the apparatus has sensed the presence of a shell case in a position to receive material and allows dispensing of material thereto.

As the shell plate holder 20 again is lowered, it will engage nut 140 on rod 132 to shift the slide bar 108 to the left in FIG. 4 whereby bores 110, 112 again underlie their associated hoppers. Since bore 110 has not been able to dispense powder therefrom during the prior action, no additional powder will be needed to fill it. However, since the shot from bore 112 has been dispensed because there was a shell present to receive such, when bore 112 is shifted back into position under hopper 64, it will receive a new charge of material, such as shot.

From the above, it will be seen that apparatus is provided capable of sensing the absence or presence of a shell case in the reloading apparatus and will dispense shell loading material or component only when a shell case is available to receive such. Since only a minor portion of the assembly is required to be moved by the tubing assembly, it minimizes the force necessary to shift the assembly between a dispensing and non-dispensing configuration. This, therefore, imposes a fairly low load, or stress, on the shell case being sensed and loaded.

Further, the apparatus provides means for placing a hopper in a selected position wherein its outlet is blocked permitting loading of the hopper, a second position where it is positioned for dispensing in a reloading operation, and a third position in which the hopper may be unloaded as desired.

All of this is accomplished with easily and economically manufactured components to produce a reliable loading device.

While a preferred embodiment has been described herein, it should be apparent to those skilled in the art that variations and modifications are possible without departing from the spirit of the invention.

I claim:

1. Apparatus for reloading ammunition shell cases comprising a shell case support for holding a shell case, a container spaced above the support for holding shell loading material to place in the shell case during reloading, an elongate charge bar underlying said container having a charge opening therein, said bar being mounted for longitudinal movement between a first position in which said opening underlies said container to receive a charge of material therefrom and a second position wherein material may be released from said opening to an underlying shell case, and control mechanism operable to sense the presence or absence of the shell case on the support when said charge bar is in its second position, said control mechanism prohibiting release of material from said charge opening when the shell case is absent and permitting release of material from said charge opening when the shell case is present.

2. The apparatus of claim 1, wherein said control mechanism comprises a control member underlying said charge bar movable between a stop position operable to prevent release of material from said charge opening and a release position permitting flow of material from said charge opening.

3. The apparatus of claim 2, wherein said control member comprises a slide plate having a solid portion which underlies said charge opening when in said stop position and a release portion having an opening extending therethrough which underlies said charge opening when in said release position.

4. The apparatus of claim 3, wherein said slide plate is disposed substantially horizontally for movement horizontally under said charge bar.

5. The apparatus of claim 2, wherein said shell case support is mounted for movement toward and away from said charge bar and has a sensing opening therein underlying a region to be occupied by the shell case to be reloaded, a material feed tube is disposed between said charge bar and shell case support, said feed tube being positioned to engage a base of the shell case held on the shell case support and moved vertically therewith toward the charge bar when the shell case is present on the shell case support, and to extend into said sensing opening and not shift vertically when no shell case is present.

6. The apparatus of claim 5, which further comprises biasing means yieldably urging said control member to its stop position, and said control member and feed tube comprise operator portions which cause said control member to move against the urging of the biasing means toward its release position when the feed tube is shifted vertically.

7. The apparatus of claim 6, wherein one of said control member and feed tube has an operator member connected thereto having an angularly disposed surface which is engaged by an engaging portion of the other causing the control member to shift toward its release position.

8. The apparatus of claim 6, wherein said feed tube comprises an elongate substantially rigid tube sized to be received in the shell case with a lower end engaging a base of the shell case held on said support, the movement of which shell case raises said tube, said tube being operable to receive material from said charge bar and direct the material to a shell case.

9. The apparatus of claim 6, wherein said sensing opening has a selected side-to-side first dimension and said tube has a lower end portion of a side-to-side second dimension smaller than said first dimension allowing said lower end portion to extend through said sensing opening when the shell case is absent.

10. The apparatus of claim 5, which further comprises a charge bar support over which said charge bar moves, said charge bar support having a bore extending vertically therethrough through which material released from said charge bar may flow, said feed tube being mounted for vertical movement coaxially of said bore.

11. The apparatus of claim 10, wherein said bore has a shoulder formed therein and said feed tube has a portion thereon positioned to engage said shoulder to limit downward movement of said tube.

12. The apparatus of claim 1, wherein said shell case support is shiftable toward and away from said charge bar and which further comprises operator mechanism interconnecting said shell case support and said charge bar operable to produce shifting of said charge bar toward its second position when said shell case support is raised and to produce shifting of said charge bar toward its first position when said shell case support is lowered.

13. The apparatus of claim 12, wherein said operator mechanism comprises lost motion linkage operable to delay movement of said charge bar from its first position toward its second position until the shell case support has been raised a selected distance from a fully lowered position, and to delay movement of said charge bar from its second position toward its first position until said shell case support has been lowered another selected distance from a fully raised position.

14. The apparatus of claim 1, which comprises laterally spaced first and second containers for holding different shell loading materials to place in shell cases at different sequential steps in a progressive reloading process, said charge bar has first and second charge openings spaced longitudinally along said charge bar positioned to underlie said first and second containers respectively when said charge bar is in its first position, said charge bar when moved to its second position being operable to release material from said first charge opening to a first shell case position on said shell case support and from said second charge opening to a second shell case position on said shell case support.

15. Apparatus for delivering a desired quantity of shell loading material to an ammunition shell case in a reloading operation comprising a shell case support, a container spaced above the support for holding shell loading material to be placed in a shell case, a material transport member positioned above the shell case support and below the container, said transport member having a charge opening of a size corresponding to the quantity of material to be delivered from said container to the shell case, said transport member being shiftable from a first position wherein said charge opening is positioned to receive material from said container and a second position spaced therefrom to release material from said charge opening to an underlying shell case held on said shell case support, mechanism for driving the shell case support vertically toward and away from the transport member, and control mechanism operable to sense the presence or absence of the shell case on the support when said transport member is in its second position and said shell case support is raised toward said transport member, said control mechanism prohibiting release of material from said charge opening when the shell case is absent and permitting release of material when the shell case is present.

16. The apparatus of claim 15, wherein said transport member comprises an elongate charge bar and said charge opening comprises a bore extending vertically through said charge bar.

17. The apparatus of claim 16, which further comprises a charge bar support having an upper surface on which charge bar support a bottom surface of said charge bar complementary to said upper surface may move as the charge bar moves longitudinally between said first and second positions, a dispensing bore extends through said charge bar support through which material may pass from said charge opening, and said control mechanism comprises a control member mounted in said bore having an upper surface substantially paralleling the upper surface of said charge bar support.

18. The apparatus of claim 17, wherein said control member comprises a slide plate mounted for shifting between a stop position inhibiting release of material from said charge opening and a release position permitting such release.

19. The apparatus of claim 18, wherein said shell case support is mounted for movement toward and away from said charge bar and has a sensing opening therein underlying a region to be occupied by the shell case to be reloaded, a material feed tube is disposed between said charge bar and support, said feed tube being mounted for vertical shifting when engaged by a base of the shell case held on the support and moved toward the charge bar and to extend into said sensing opening and not shift vertically when no shell case is present.

20. The apparatus of claim 19, which further comprises biasing means yieldably urging said slide plate to its stop position, and said slide plate and feed tube comprise operator portions which cause said slide plate to move against the urging of the biasing means to its release position when the feed tube is shifted vertically.

21. The apparatus of claim 20, wherein one of said slide plate and feed tube has an operator member connected thereto having an angularly disposed surface which is engaged by an engaging portion of the other causing the slide plate to shift toward its release position.

22. The apparatus of claim 20, wherein said feed tube comprises an elongate substantially rigid tube sized to be received in the shell case with a lower end engaging a base of the shell case held on said support, the movement of which shell case raises said tube, said tube being operable to receive material from said charge bar and the material to the shell case.

23. The apparatus of claim 19, wherein said sensing opening has a selected side-to-side first dimension and said tube has a lower end portion of a side-to-side second dimension smaller than said first dimension allowing said lower end portion to extend through said sensing opening when the shell case is absent.

24. The apparatus of claim 19, which further comprises a charge bar support over which said charge bar moves, said charge bar support having a bore extending vertically therethrough through which material released from said charge bar may flow, said feed tube being mounted for vertical movement coaxially of said bore.

25. The apparatus of claim 24, wherein said bore has a shoulder formed therein and said feed tube has a portion thereon positioned to engage said shoulder to limit downward movement of said tube.

26. The apparatus of claim 15, wherein said shell case support is mounted for movement toward and away from said transport member and has a sensing opening therein underlying a region to be occupied by the shell case to be reloaded, a material feed tube is disposed between said transport member and said shell case support, said feed tube being mounted for vertical shifting when engaged by a base of the shell case held on the shell case support and moved toward the transport member and to extend into said sensing opening and not shift vertically when no shell case is present.

27. The apparatus of claim 26, wherein said control mechanism comprises a control member mounted for shifting between a stop position inhibiting release of material from said charge opening and a release position permitting such release and biasing means yieldably urging said control member toward its stop position, and said control member and feed tube comprise operator portions which cause said control member to move against the urging of the biasing means to its release position when the feed tube is shifted vertically.

28. The apparatus of claim 27, wherein one of said control member and feed tube has an operator member connected thereto having an angularly disposed surface which is engaged by an engaging portion of the other causing the control member to shift toward its release position.

29. The apparatus of claim 27, wherein said feed tube comprises an elongate substantially rigid tube sized to be received in the shell case with a lower end engaging a base of the shell case held on said support, the movement of which shell case raises said tube, said tube being operable to receive material from said transport member and direct the material to the shell case.

30. The apparatus of claim 26, wherein said sensing opening has a selected side-to-side first dimension and said tube has a lower end portion of a side-to-side second dimension smaller than said first dimension allowing said lower end portion to extend through said sensing opening when the shell case is absent.

31. The apparatus of claim 15, wherein said shell case support is shiftable toward and away from said transport member and which further comprises operator mechanism interconnecting said shell case support and said transport member operable to produce shifting of said transport member toward its second position when said shell case support is raised and to produce shifting of said transport member toward its first position when said shell case support is lowered.

32. The apparatus of claim 31, wherein said operator mechanism comprises lost motion linkage which delays movement of said transport member from its first position toward its second position until the shell case support has been raised a selected distance from a fully lowered position, and delays movement of said transport member from its second position toward its first position until said shell case support has been lowered another selected distance from a fully raised position.

33. The apparatus of claim 15, which comprises two laterally spaced first and second containers for holding different shell loading materials to place in shell cases at different sequential steps in a progressive reloading process, said transport member has first and second charge openings spaced apart thereon to underlie said first and second containers respectively when said transport member is in its first position, said transport member when moved to its second position being operable to release material from said first charge opening to a first shell case position on said shell case support and from said second charge opening to a second shell case position on said shell case support.

34. Ammunition reloading apparatus comprising a head member having a feed opening therein a hopper for containing shell loading material, said hopper having a discharge opening overlying said head member, a movable charge bar disposed between the feed opening and the discharge opening, said bar having a charge passage extending therethrough positioned to receive material from said discharge opening and to transfer said material to said feed opening, a shell case support underlying said head member, mechanism operable to raise and lower said shell case support and a shell case held thereon toward and away from said head member, and control mechanism operable to sense the presence or absence of the shell case on the shell case support as the shell case support is raised toward said head member, said control mechanism prohibiting release of material from said charge passage when the shell case is absent and permitting release of material when the shell case is present.

35. Apparatus for reloading ammunition shell cases comprising a container for holding flowable shell loading material to place in a shell case during reloading, a shell case support mounted beneath said container and movable vertically toward and away from said container, said shell case support having a sensing opening therein underlying a region to be occupied by a shell case to be reloaded, an elongate charge bar underlying said container and spaced above said support, said charge bar having a charge opening therein having an upper infeed and a lower outfeed, said bar being mounted for longitudinal movement between a first position in which said infeed underlies said container to receive a charge of material therefrom and a second position wherein said outfeed is positioned to release material from said charge opening to flow to an underlying shell case, and control mechanism operable to sense the presence or absence of the shell case on the shell case support when said charge bar is in its second position and to prohibit release of material from said charge opening when the shell case is absent and to permit release of material when the shell case is present, said control mechanism comprising a control member mounted for shifting beneath said charge bar between a closed position blocking the outfeed of said charge opening and a release position spaced from said outfeed, and a material feed tube mounted between said control member and said support for vertical shifting when engaged by a base of the shell case on the shell case support and to extend into said sensing opening on the support and not shift vertically when no shell case is present, said control member and feed tube having operator portions thereon which engage to cause said control member to move from its closed position to its release position when the feed tube is shifted vertically.

36. The apparatus of claim 35, wherein said feed tube comprises an elongate substantially rigid tube sized to be received in the shell case with a lower end engaging a base of the shell case held on said shell case support, the movement of which shell case and shell case support raises said tube, said tube being operable to receive material from said charge bar and direct the material to the shell case, said sensing opening in said support has a selected side-to-side first dimension and said tube has a lower end portion of a side-to-side second dimension smaller than said first dimension allowing said lower end portion to extend through said sensing opening when the shell case is absent.

37. The apparatus of claim 36, wherein said shell case support is shiftable toward and away from said charge bar and which further comprises operator mechanism interconnecting said shell case support and said charge bar operable to produce shifting of said charge bar toward its second position when said shell case support is raised and to produce shifting of said charge bar toward its first position when said shell case support is lowered.

38. The apparatus of claim 37, wherein said operator mechanism comprises lost motion linkage which delays movement of said charge bar from its first position toward its second position until the shell case support has been raised a selected distance from a fully lowered position, and delays movement of said charge bar from its second position toward its first position until said shell case support has been lowered another selected distance from a fully raised position.

* * * * *